US005902683A

United States Patent [19]

Sieloff

[11] Patent Number: 5,902,683

[45] **Date of Patent: *May 11, 1999**

[54] CONSTRUCTION SHINGLE

[75] Inventor: Ronald F. Sieloff, Evansville, Ind.

[73] Assignee: General Electric Company, Pittsfield, Mass.

[ * ] Notice: This patent is subject to a terminal disclaimer.

[21] Appl. No.: 08/697,802

[22] Filed: Aug. 30, 1996

[51] Int. Cl.[6] ..... B32B 27/36

[52] U.S. Cl. ..... 428/412

[58] Field of Search ..... 428/412

[56] References Cited

U.S. PATENT DOCUMENTS

| | | | |
|---|---|---|---|
| 4,034,528 | 7/1977 | Sanders et al. | 52/309.4 |
| 4,096,011 | 6/1978 | Sanders et al. | 156/196 |
| 4,308,702 | 1/1982 | Rajewski | 52/519 |
| 5,001,177 | 3/1991 | Winfried et al. | 524/86 |
| 5,108,835 | 4/1992 | Hahnsen et al. | 428/334 |

*Primary Examiner*—Mark Chapman

[57] ABSTRACT

The disclosure is of a building construction shingle of a synthetic polymeric resin protected from weathering with a laminated layer of U-V resistant polycarbonate resin.

4 Claims, 1 Drawing Sheet

CONSTRUCTION SHINGLE

BACKGROUND OF THE INVENTION

1. Field of The Invention

The invention relates to construction materials and more particularly to shingles for roofing and siding applications on the exterior of a building.

2. Brief Description of the Related Art

Building panels useful as a roofing and siding material (shingles and clapboard) have been described as being thermoformed from polycarbonate resins; see for example U.S. Pat. No. 4,308,702. As is also described in this patent, the polycarbonate resin used in thermoforming can be compounded with fillers such as glass fibers and with other additives such as coloring pigments. Although polycarbonate resins can be formulated to provide molded articles with a wide range of properties advantageous to exterior building panels, resistance to ultra-violet light degradation is difficult to achieve, without sacrificing moldability. Useful quantities of ultra-violet absorbing compounds, when added to polycarbonate resins, particularly in the presence of coloring pigments, adversely affect the polymers melt rheology making melt flow difficult to control.

In spite of the difficulty in molding polycarbonate resins containing ultra-violet light resisting agents, polycarbonate resins do have other properties which make them valuable as wear surfaces. In fact, the U.S. Pat. Nos. 4,034,528 and 4,096,011 have suggested that they be used to surface clad vinyl resin exterior sidings. If they could be formulated to resist degradation from exposure to ultra-violet radiation without adversely affecting processability, a major advance in the art would follow. This did happen in regard to branched aromatic polycarbonate resins, wherein it was discovered that they were compatible with a specific class of ultra-light absorbing benzotriazole's; see U.S. Pat. No. 5,001,177. But branched or highly cross-linked polycarbonate resins, with or without resistance to ultra-violet radiation, are too brittle to be useful as an impact-resistant exterior building material, even as a surface cladding which is suggested in the '177 patent.

SUMMARY OF THE INVENTION

The invention comprises a self-supporting, laminate shingle for the exterior of a building construction, having resistance to ultra-violet radiation caused degradation, which comprises;

a. a rigid substrate of a thermoplastic, synthetic polymeric resin; and b. a flexible film of an aromatic, straight chain polycarbonate resin blend containing 0.5 to 15 percent by weight of an ultra-violet radiation absorbing agent; laminated to a surface of the substrate intended for exposure to weather.

DETAILED DESCRIPTION OF THE PREFERRED EMBODIMENTS OF THE INVENTION

Figure 1:
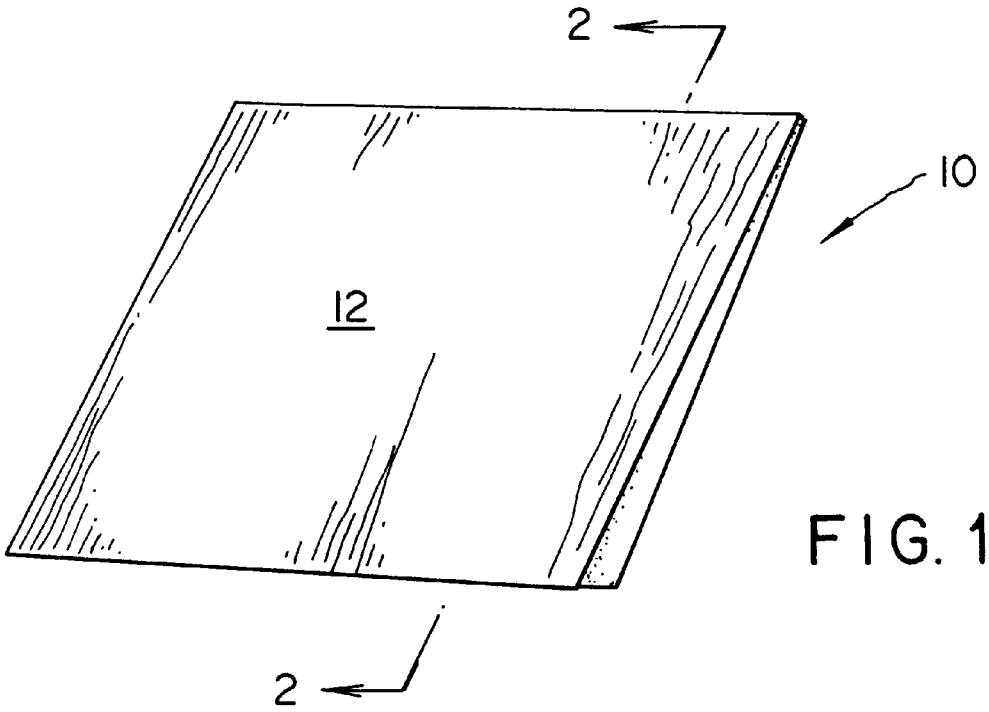
FIG. 1 is a view-in-perspective of an embodiment roof shingle of the invention.
Figure 2:
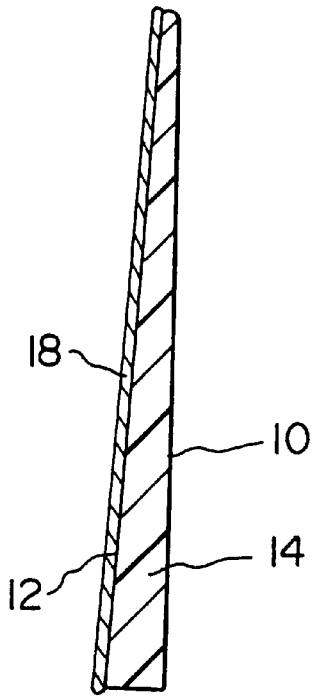
FIG. 2 is a cross-sectional view along lines 2—2 of FIG. 1.

Those skilled in the art will gain an understanding of the invention from a reading of the following description of the preferred embodiments in conjunction with a viewing of the accompanying drawings of FIGS. 1 and 2.

FIG. 1 is a view-in-perspective of an embodiment roof shingle 10 which can be used in a building construction as an exterior siding or roof shingle. The surface 12 exposed to the weather can be smooth or textured as will be described more fully hereinafter.

Referring now to FIG. 2, a cross-sectional side elevation along lines 2—2 of FIG. 1, one can see that the shingle 10 is a laminated structure, consisting of a thermoplastic, synthetic polymeric resin substrate 14 covered on the side 12 with a laminated film 18 of a flexible, straight chain, aromatic polycarbonate resin.

The substrate 14 may be thermoformed from any conventional, synthetic polymeric resin having sufficient ability to be self-supporting. Substrate 14 is advantageously 10 to 300 mils in thickness. Representative of such polymeric resins are polyolefins (e.g. polyvinyl chloride, polyvinyl fluoride, polyethylene) polystyrene (ABS), acrylic resins and the like. Preferably, the substrate 14 is molded from a thermoplastic, aromatic, straight-chain polycarbonate resin.

The preferred aromatic, straight-chain polycarbonate resins for substrate 14 are a well known class of thermoformable resins, prepared by the interfacial polymerization of a dihydric phenol with a carbonyl halide (the carbonate precursor) in the presence of a water immiscible solvent.

Although the reaction conditions of the preparative processes may vary, several of the preferred processes typically involve dissolving or dispersing a diphenol reactant in aqueous caustic, adding the resulting mixture to a suitable water immiscible solvent medium and contacting the reactants with a carbonate precursor, under controlled pH conditions. The most commonly used water immiscible solvents include methylene chloride, 1,2-dichloroethane, chlorobenzene, toluene, and the like.

Representative of descriptions in the literature for preparing polycarbonate resins are those found, for example, in the U.S. Pat. Nos. 3,028,365; 3,334,154; 3,275,601; 3,915,926; 3,030,331; 3,169,121; 3,027,814; and 4,188,314, all of which are incorporated herein by reference thereto.

The term "polycarbonate" as used herein is inclusive of polyester-carbonates [also known as "copoly-(ester-carbonates)" or "polyester-polycarbonates"], a well known class of thermoplastic resin as is their preparation; see for example the descriptions given in U.S. Pat. Nos. 3,169,121 and 4,487,896. Also incorporated herein by reference thereto.

In general, the polyester-carbonate resins are prepared by the same polymerization techniques used for polycarbonate homopolyners, but with the added presence of an ester precursor.

The preferred process for preparing polycarbonate homopolymers and polyester-carbonate resins comprises a phosgenation reaction. The temperature at which the phosgenation reaction proceeds may vary from below 0° C., to above 100° C. The phosgenation reaction preferably proceeds at temperatures of from about room temperatures (25° C.) to 50° C. Since the reaction is exothermic, the rate of phosgene addition may be used to control the reaction temperature. The amount of phosgene required will generally depend upon the amount of the dihydric phenol reactant added.

The dihydric phenols employed are known, and the reactive groups are the two phenolic hydroxyl groups. Some of the dihydric phenols are represented by the general formula:

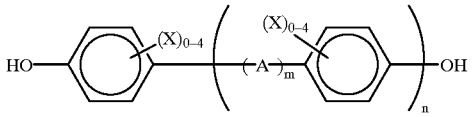

wherein A is a divalent hydrocarbon radical containing from 1 to about 15 carbon atoms; a substituted divalent hydrocarbon radical containing from 1 to about 15 carbon atoms and substituent groups such as halogen; —S—; —S(O)—; —$S(O)_2$—; —O—; or —C(O)—; each X is independently selected from the group consisting of hydrogen, halogen, and a monovalent hydrocarbon radical such as an alkyl group of from 1 to about 8 carbon atoms, an aryl group of from 6–18 carbon atoms, an aralkyl group of from 7 to about 14 carbon atoms, an alkaryl group of from 7 to about 14 carbon atoms, an alkoxy group of from 1 to about 8 carbon atoms, or an aryloxy group of from 6 to 18 carbon atoms; and m is zero or 1 and n is an integer of from 0 to 5.

Typical of some of the dihydric phenols employed are bis-phenols such as (4-hydroxyphenyl)methane, 2,2-bis(4-hydroxyphenyl)propane (also known as bisphenol-A), 2,2-bis(4-hydroxy-3,5-dibromophenyl)propane; dihydric phenol ethers such as bis(4-hydroxyphenyl) ether, bis(3,5-dichloro-4-hydroxyphenyl) ether; dihydroxydiphenyls such as p,p'-dihydroxydiphenyl, 3,3'-dichloro-4,4'-dihydroxydiphenyl; dihydroxyaryl sulfones such as bis(4-hydroxyphenyl) sulfone, bis (3,5-dimethyl-4-hydroxyphenyl) sulfone, dihydroxybenzenes such as resorcinol, hydroquinone, halo- and alkyl-substituted dihydroxybenzenes such as 1,4-dihydroxy-2,5-dichlorobenzene, 1,4-dihydroxy-3-methylbenzene; and dihydroxydiphenyl sulfides and sulfoxides such as bis(4-hydroxyphenyl) sulfide, bis(4-hydroxyphenyl) sulfoxide and bis(3,5-dibromo-4-hydroxyphenyl) sulfoxide. A variety of additional dihydric phenols are available and are disclosed in U.S. Pat. Nos. 2,999,835; 3,028,365 and 3,153,008; all of which are incorporated herein by reference thereto. It is, of course, possible to employ two or more different dihydric phenols or a combination of a dihydric phenol with a glycol.

The carbonate precursor can be either a carbonyl halide, a diarylcarbonate or a bishaloformate. The carbonyl halides include carbonyl bromide, carbonyl chloride, and mixtures thereof. The bishaloformates include the bishaloformates of dihydric phenols such as bischloroformates of 2,2-bis(4-hydroxyphenyl)propane, 2,2-bis(4-hydroxy-3,5-dichlorophenyl)propane, hydroquinone, and the like, or bishaloformates of glycols such as bishaloformates of ethylene glycol, and the like. While all of the above carbonate precursors are useful, carbonyl chloride, also known as phosgene, is preferred.

In general, any dicarboxylic acid conventionally used in the preparation of linear polyesters may be utilized as the ester precursor in the preparation of the polyester-carbonate resins used in the instant invention. Generally, the dicarboxylic acids which may be utilized include the aliphatic dicarboxylic acids, the aromatic dicarboxylic acids, and the aliphatic-aromatic dicarboxylic acids. These acids are well known and are disclosed for example in U.S. Pat. No. 3,169,121 which is hereby incorporated herein by reference. Representative of dicarboxylic acids are those represented by the general formula:

$$HOOC—R^1—COOH$$

wherein $R^1$ represents a divalent aliphatic radical such as alkylene, alkylidene, cycloalkylene or substituted alkylene or alkylidene; an aromatic radical such as phenylene, naphthylene, biphenylene, substituted phenylene and the like; a divalent aliphatic-aromatic hydrocarbon radical such as an aralkyl or alkaryl radical; or two or more aromatic groups connected through non-aromatic linkages of the formula:

—E— wherein E is a divalent alkylene or alkylidene group. E may also consist of two or more alkylene or alkylidene groups, connected by a non-alkylene or alkylidene group, connected by a non-alkylene or non-alkylidene group, such as an aromatic linkage, a tertiary amino linkage, an ether linkage, a carbonyl linkage, a silicon-containing linkage, or by a sulfur-containing linkage such as sulfide, sulfoxide, sulfone and the like. In addition, E may be a cycloaliphatic group of five to seven carbon atoms, inclusive, (e.g. cyclopentyl, cyclohexyl), or a cycloalkylidene of five to seven carbon atoms, inclusive, such as cyclohexylidene. E may also be a carbon-free sulfur-containing linkage, such as sulfide, sulfoxide or sulfone; an ether linkage; a carbonyl group; a direct bond; a tertiary nitrogen group; or a silicon-containing linkage such as silane or siloxy. Other groups which E may represent will occur to those skilled in the art.

Some non-limiting examples of aromatic dicarboxylic acids which may be used in preparing the poly(ester-carbonate) include phthalic acid, isophthalic acid, terephthalic acid, homophthalic acid, o-, m-, and p-phenylenediacetic acid, and the polynuclear aromatic acids such as diphenyl dicarboxylic acid, and isomeric naphthalene dicarboxylic acids. The aromatics may be substituted with Y groups. Y may be an inorganic atom such as chlorine, bromine, fluorine and the like; an organic group such as the nitro group; an organic group such as alkyl; or an oxy group such as alkoxy, it being only necessary that Y be inert to and unaffected by the reactants and the reaction conditions. Particularly useful aromatic dicarboxylic acids are those represented by the general formula:

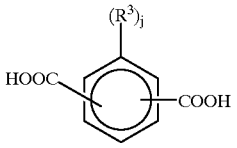

wherein j is a positive whole integer having a value of from 0 to 4 inclusive; and each $R^3$ is independently selected from the group consisting of alkyl radicals, preferably lower alkyl (1 to about 4 carbon atoms).

Most preferred as aromatic dicarboxylic acids are isophthalic acid, terephthalic acid, and mixtures thereof.

Representative of aliphatic dicarboxylic acids within the formula given above wherein $R^1$ is alkylene are butanedioic acid, hexanedioic acid, octanedioic acid, decanedioic acid, dodecanedioic acid and the like. Preferred are dicarboxylic acids having from 4 to 18 carbon atoms, inclusive.

Mixtures of the dicarboxylic acids may be employed. Therefore, where the term dicarboxylic acid is used herein it is to be understood that this term includes mixtures of two or more dicarboxylic acids.

The proportions of reactants employed to prepare the polyester-carbonate resins used in the invention will vary. Those skilled in the art are aware of useful proportions, as described in the U.S. patents referred to above. In general, the amount of the ester bonds may be from about 5 to about 90 mole percent, relative to the carbonate bonds. For example, 5 moles of bisphenol A reacting completely with 4 moles of isophthaloyl dichloride and 1 mole of phosgene would give a polyester-carbonate of 80 mole percent ester bonds.

The preferred polycarbonates for use in substrate 14 are those derived from bisphenol A and phosgene and having an intrinsic viscosity of about 0.3 to about 1.5 deciliters per gram in methylene chloride at 25° C.

In the conventional interfacial polymerization methods of preparing polycarbonate homopolymers and polyester-carbonates a molecular weight regulator (a chain stopper) is generally added to the reaction mixture prior to or during the contacting with carbonate and ester precursors. Useful molecular weight regulators include, but are not limited to, monohydric phenols such as phenol, chroman-I, para-tertiarybutylphenol, p-cumylphenol and the like. Techniques for the control of molecular weight are well known in the art and are used for controlling the molecular weight of the polyester-carbonate resins used in the present invention.

Those skilled in the art will appreciate that preferred polycarbonates described herein may be characterized as containing recurring polycarbonate chain units of the formula:

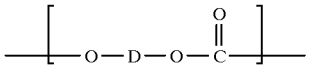

(I)

wherein D is a divalent aromatic radical of the dihydric phenol employed in the resin preparation; and may contain repeating or recurring carboxylic chain units of the formula:

$$—O—R^1—O—D \quad (II)$$

wherein D and $R^1$ have the meanings previously ascribed to them. The preferred polycarbonate resins are advantageously reinforced with a fibrous reinforcing agent.

Fibrous reinforcing agents employed in plastic molding compositions are generally well known and are represented by glass fibers, mineral fibers such as rockwool, carbon fibers and the like. Preferred reinforcing agents are glass fibers such as cut glass filaments (long glass fiber and short glass fiber) rovings and staple fiber.

The filamentous glass that may be used in the substrate 14 are well known to those skilled in the art and is widely available from a number of manufacturers. The glass may be untreated or, preferably, treated with silane or titanate coupling agents. It is convenient to use the filamentous glass in the form of chopped strands of from about 0.25 cm to about 5 cm long.

The polycarbonate compositions for substrate 14 advantageously include an impact-modifying proportion of an impact modifier. Any of the known impact modifiers for polycarbonates may be used. Representative of such impact-modifiers are selectively hydrogenated linear, sequential or radial teleblock copolymers of a vinyl aromatic compound (A) and $(A')_n$ and an olefinic elastomer (B) of the A-B-A'; A $(B\text{-}A\text{-}B)_nA$; A $(B\text{-}A)_nB$; or B $[(A\text{-}B_n)B]_4$ type wherein n is an integer of from 1 to 10 inclusive; see for example Haefele et al, U.S. Pat. No. 3,333,024, which is incorporated herein by reference.

Preferred as an impact-modifier used in the substrate 14 are the so-called "ABS" polymers. ABS polymers are defined, for example, in the Modern Plastics Encyclopedia, 1989 edition, page 92, as the family of thermoplastics made from the three monomers acrylonitrile, butadiene and styrene, and more specifically as a mixture (alloy) of styrene-acrylonitrile copolymer with SAN-grafted polybutadiene rubber.

Impact-modifying agents for use with the polyester-carbonate based substrates 14 also include the various polyacrylate resins known in the art. For example, polyacrylates are commercially available from many sources, e.g., Rohm & Haas Chemical Company, Philadelphia, Pa. under the trade designations Acryloid® KM 330, and 7709 XP; Goodyear Tire & Rubber Company, Akron, Ohio under the trade designation RXL® 6886; from American Cyanamid Company, Stamford, Conn., under the trade designation Cyanacryl® 770; from M&T Chemicals Co., Trenton, N.J., under the trade designation Durostrength® 200; and from Polysar Corporation, Canada, under the trade designation Polysar® §1006.

The polyacrylate resin impact modifiers may be added to the polycarbonate resins in conventional amounts of from 0.01% to 50% by weight based on the weight of the overall composition and usually in amounts of from 0.01% to 10% by weight on the same basis.

Another class of known impact modifiers which may be used as an ingredient of the resin compositions of the invention are polyamide-polyether block copolymers which may be represented by the formula:

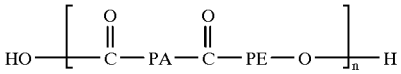

wherein PA represents the polyamide segment, PE represents a polyether segment and n is an integer such that the block copolymer has a weight average molecular weight (Mw) of from about 5,000 to about 100,000. Polyamide-polyether block copolymers of the class described above are generally well known and may be prepared for example by the condensation reaction of a prepolyamide and a polyoxyalkylene glycol, by conventional technique; see for example the preparative methods described in U.S. Pat. Nos. 4,208,493; 4,230,838; 4,361,680; and 4,331,786, all of which are incorporated herein by reference thereto. The polyamide-polyether block copolymers so prepared are commercially available and may be wide ranging in their make-up from a wide range of prepolyamides and polyoxyalkylene glycols.

Impact-modifying proportions of the polyamide-polyether block copolymers are generally within the range of from about 0.1 to 10 percent by weight of the resin composition.

Further examples of impact modifiers which may be added to the polycarbonate resins are well known in the art.

The thermoplastic compositions employed as substrate 14 may also be compounded with conventional molding aids such as, for example, antioxidants; antistatic agents; hydrolytic stabilizers such as the epoxides disclosed in U.S. Pat. Nos. 3,489,716, 4,138,379 and 3,839,247, all of which are incorporated herein by reference; color stabilizers such as the organophosphites; thermal stabilizers such as phosphite; mold release agents and the like.

Preferred embodiment shingles of the invention include in the polycarbonate substrate 14 as an additive ingredient, flame retarding agents. In general, the presence of impact-modifiers in polycarbonate based molding compositions is degradative to the action of fire retardants. However, in the articles of the present invention, reductions in flame-retardance due to presence of the impact-modifier is not significant.

Some particularly useful flame retardants are the alkali and alkaline earth metal salts of sulfonic acids. These types of flame retardants and there use are disclosed in U.S. Pat. Nos. 3,933,734; 3,931,100; 3,978,024; 3,948,851; 3,926,980; 3,919,167; 3,909,490; 3,953,396; 3,953,300; 3,917, 559; 3,951,910 and 3,940,366, all of which are hereby incorporated herein by reference.

Flame-retarding proportions of flame retardants vary in accordance with the specific flame retardant. In general, a flame-retarding proportion comprises from 0.01 to about 20 weight percent of the total polycarbonate composition.

Films 18 of flexible polycarbonate resins are generally well known and are available commercially from the General Electric Company, Plastics Division, Pittsfield, Mass. Advantageously, the films 18 are prepared from the polycarbonate resins described above, having a thickness of 1 to 15 mils and formulated to contain from about 1 to 30 percent by weight of an ultra-violet light absorbing agent. Representative of ultra-violet light absorbing agents are those described, for example, in the U.S. Pat. Nos. 2,976,259; 3,043,709; 3,049,443, 3,214,436, 3,309,220; 4,556,606 and Re 2, 976 all of which are incorporated herein by reference thereto.

Preferably, the ultra-violet light absorbing agent selected for use in the present invention is Tinuvin® 234 a benzotriazole manufactured by Ciba-Geigy Corporation, Hawthorne, N.Y.

A conventional coloring pigment may also be blended into the film resin 18 in a coloring proportionm, but is preferably blended into the polycarbonate resin forming the substrate 14.

The film 18 is, according to the method of the present invention, laminated to a surface 12 of the substrate 14 for protection of the surface 12 from weathering. Lamination can be carried out by one of several known techniques. For example, the substrate 12 and film 18 may be co-extruded using the techniques in U.S. Pat. No. 4,056,344, or as described in U.S. Pat. No. 4,992,322. Advantageously, the film 18 is prepared separately from the substrate 14 and laminated thereon under heat and pressure using conventional laminating presses. The latter method possesses the advantages of avoiding melt flow problems which may be associated with extrusion of the substrate 14 or film 18 and an ability to texture the surface 12 of the shingle 10.

Alternatively, the film 18 can bear a surface impregnation or coating of the ultra-violet light absorbing compound and pigment, applied for example by the method described in U.S. Pat. No. 5,271,968.

By using coextrusion or Surface Impregnation Technology a surface film 18 can be prepared with high ultra-violet light resistance at the surface 12 and have a color present.

Coextrusion of a film 18 containing a high level of UV absorber over a base polycarbonate obviates incompatability (i.e., melt flow) problems. Likewise using surface impregnation techniques to put ultra-violet light absorbers into the surface of a colored polycarbonate film overcomes melt stability problems.

The following example and preparation describe the manner and process of making and using the invention and set forth the best mode contemplated by the inventor for carrying out the invention but are not to be construed as limiting the invention. Where shown the Delta E Color test results were after 17,280 hours (10 year S. Florida equivalent) of exposure according to ASTM test Method D 5071-91.

EXAMPLE

A co-extruded sheet was formed with a polycarbonate resin core and a cap of film of polycarbonate resin (about 10 mils thick) on the exterior of the core, following the procedure of U.S. Pat. No. 4,056,344. The cap layer comprised a polycarbonate resin blend containing 8.0 percent by weight of Tinuvin® 234 (Ciba-Geigy Corp.) a benzotriazole U-V light absorbing compound and a coloring proportion of a pigment. The co-extruded sheet was tested for its resistance to weathering. The test results (Delta E Color) are shown in the Table below.

For comparative purposes, the core extrusion (without a cap) was painted with a number of urethane or acrylic enamels and tested also. The test results are given in the Table below.

TABLE

| MATERIAL | DELTA E COLOR |
|---|---|
| Coex Structure of invention where the pigment is: | |
| - Tile Red in Color | 2.3 |
| - Light Brown in Color | 3.7 |
| - Gray in Color | 3.4 |
| Tile Red Urethane Enamel Paint (Lilly Industries 92702-1774) | 11.0 |
| Tile Red Waterbase Acrylic Enamel Paint (Lilly (Industries 92739-1777) | 8.8 |
| Lt. Brown Urethane Enamel Paint (Lilly Industries 92702-1775) | 11.0 |
| Gray Urethane Enamel Paint (Lilly Industries 92702-1776) | 15.0 |

What is claimed is:

1. A self-supporting laminate shingle for the exterior of a building, said shingle having resistance to damage caused by ultra-violet radiation, wherein said shingle comprises:

a. a textured rigid substrate of a thermoplastic, synthetic polymeric resin; and b. a flexible film of an aromatic, straight chain polycarbonate resin blend containing 0.5 to 15 percent by weight of an ultra-violet radiation absorbing agent; wherein the flexible film is laminated to a surface of the rigid substrate intended for exposure to weather, and wherein the film is laminated to the surface by a laminating press.

2. The shingle of claim 1 wherein the rigid substrate is a thermoformed, straight chain, aromatic polycarbonate resin.

3. The shingle of claim 1 wherein the film also contains a coloring proportion of a pigment.

4. A self-supporting laminate shingle for the exterior of a building, said shingle having resistance to damage caused by ultra-violet radiation wherein said shingle comprises:

a. a textured rigid substrate of a thermoplastic, synthetic polymeric resin colored with a coloring proportion of a pigment; and b. a flexible film of an aromatic, straight chain polycarbonate resin blend containing 0.5 to 15 percent by weight of an ultra-violet radiation absorbing agent; wherein the flexible film is laminated to a surface of the rigid substrate intended for exposure to weather, and wherein the film is laminated to the surface by a laminating press.

* * * * *